US005420613A

United States Patent [19]

Saisho et al.

[11] Patent Number: 5,420,613

[45] Date of Patent: May 30, 1995

[54] INDIRECT THERMAL TRANSFER PRINTING METHOD WITH A MULTI-USABLE TRANSFER INK SHEET

[75] Inventors: Masao Saisho; Jun Sogabe; Katsuhiro Yoshida; Naohiro Ikeda, all of Osaka, Japan

[73] Assignee: Fujicopian Co. Ltd., Osaka, Japan

[21] Appl. No.: 160,335

[22] PCT Filed: Jul. 6, 1992

[86] PCT No.: PCT/JP92/00862

§ 371 Date: Mar. 5, 1993

§ 102(e) Date: Mar. 5, 1993

[87] PCT Pub. No.: WO93/01059

PCT Pub. Date: Jan. 21, 1993

Related U.S. Application Data

[62] Division of Ser. No. 982,752, Mar. 5, 1993, abandoned.

[30] Foreign Application Priority Data

Jul. 6, 1991 [JP] Japan ..... 3-166030

[51] Int. Cl.[6] ..... B41M 5/25

[52] U.S. Cl. ..... 347/217; 101/487; 101/492; 428/195; 428/484; 428/488.1; 428/913; 428/914

[58] Field of Search ..... 428/195, 484, 488.1, 428/522, 913, 914; 346/76 PH; 101/487, 488, 492; 156/240, 234, 235

[56] References Cited

U.S. PATENT DOCUMENTS

| | | | |
|---|---|---|---|
| 4,617,224 | 10/1986 | Hotta et al. | 428/212 |
| 4,792,496 | 12/1988 | Koshizuka et al. | 428/484 |
| 4,828,922 | 5/1989 | Koshizuka et al. | 428/484 |
| 4,882,593 | 11/1989 | Touma et al. | 346/111 |
| 5,168,289 | 12/1992 | Katakabe et al. | 346/76 PH |
| 5,263,781 | 11/1993 | Mima et al. | 400/120 |
| 5,294,277 | 3/1994 | Obata | 156/235 |

FOREIGN PATENT DOCUMENTS

| | | |
|---|---|---|
| 0076044A | 4/1983 | European Pat. Off. . |
| 0351794A | 1/1990 | European Pat. Off. . |
| 59-24693A | 2/1984 | Japan . |
| 60-36189A | 2/1985 | Japan . |
| 62-267189A | 11/1987 | Japan . |
| 62-280080A | 12/1987 | Japan . |
| 63-104883A | 5/1988 | Japan . |

*Primary Examiner*—Patrick J. Ryan
*Assistant Examiner*—Marie R. Macholl
*Attorney, Agent, or Firm*—Adduci, Mastriani, Schaumberg & Schill

[57] ABSTRACT

A multi-usable thermal transfer ink sheet wherein on a foundation is provided a thermal transfer ink layer which is tranferable in portions in terms of the thickness thereof. To realize multi-printing even in an indirect thermal transfer method, the multi-usable thermal transfer ink sheet is characterized in that the thermal transfer ink layer contains as main ingredients thereof a wax compound having a polar group, and a pigment.

3 Claims, 1 Drawing Sheet

INDIRECT THERMAL TRANSFER PRINTING METHOD WITH A MULTI-USABLE TRANSFER INK SHEET

This application is a divisional of application Ser. No. 07/982,752 filed Mar. 5, 1993, (now abandoned).

TECHNICAL FIELD

The present invention relates to a multi-usable thermal transfer ink sheet and, more particularly, to a thermal transfer ink sheet which is multi-usable in an indirect themal transfer method.

BACKGROUND ART

There has hitherto been known a multi-usable thermal transfer ink sheet in which on a foundation is provided a heat-meltable thermal transfer ink layer containing a heat-meltable substance and a pigment as main ingredients. Such an ink sheet is adapted to transfer the thermal transfer ink layer in portions in terms of the thickness thereof onto a receptor every time the ink layer is heated by a thermal head.

As far as a thermal transfer ink sheet of this type is used in printing with a common thermal transfer method (hereinafter referred to as "direct thermal transfer method") wherein a thermal transfer ink sheet is superimposed on a receptor and ink of the ink sheet is directly transferred onto the receptor, such a thermal transfer ink sheet has been capable of being reused some times.

Recently, on the other side, there has been proposed a thermal transfer method called "indirect thermal transfer method".

This indirect thermal transfer method uses a device such as shown in FIG. 1. In FIG. 1, numeral 10 denotes a rotatable transfer drum of which the surface is composed of an elastic material of good releasing property such as silicone rubber or fluorine-containing rubber. Numeral 11 denotes a recording part which is arranged so that a thermal head 13 can press a thermal transfer ink sheet 12 against the transfer drum 10. The ink sheet 12 is moved in the direction indicated by an arrow as the transfer drum 10 rotates for recording. Numeral 14 denotes a transfer part which is arranged so that a receptor 15 can be pressed against the transfer drum 10 by means of a pressing roller 16. In printing the receptor 15 is moved in the direction indicated by an arrow.

The thermal head 13 heats the thermal transfer ink sheet 12 so as to soften or melt the ink thereof which is then transferred onto the surface of the transfer drum 10. While the transfer drum 10 and the ink sheet 12 are thus moved in the directions indicated by the arrows, respectively, the softened or molten ink is transferred onto the transfer drum 10 so as to form an inked image 17 thereon. The inked image 17 is moved to the transfer part 14 as the transfer drum 10 rotates, pressed against the receptor 15 there, and transferred onto the receptor 15 to form a final inked image 18.

The transfer drum 10 is always heated at about 60° to about 80° C. for ease of transfer of the inked image thereon onto the receptor 15.

The present inventors attempted to carry out multi-printing by using a multi-usable thermal transfer ink sheet of the aforesaid type in such an indirect thermal transfer method. As a result, it was found that multi-printing was difficult because of poor transferability of ink onto the transfer drum.

In view of the above-mentioned, it is an object of the present invention to provide a thermal transfer ink sheet capable of multi-printing even in the indirect thermal tranfer method.

DISCLOSURE OF THE INVENTION

The present invention relates to a multi-usable thermal transfer ink sheet comprising a foundation and a thermal transfer ink layer disposed on the foundation and which is transferable in portions in terms of the thickness thereof, the thermal transfer ink layer containing as main ingredients a wax compound having a polar group, and a pigment.

Figure 1:
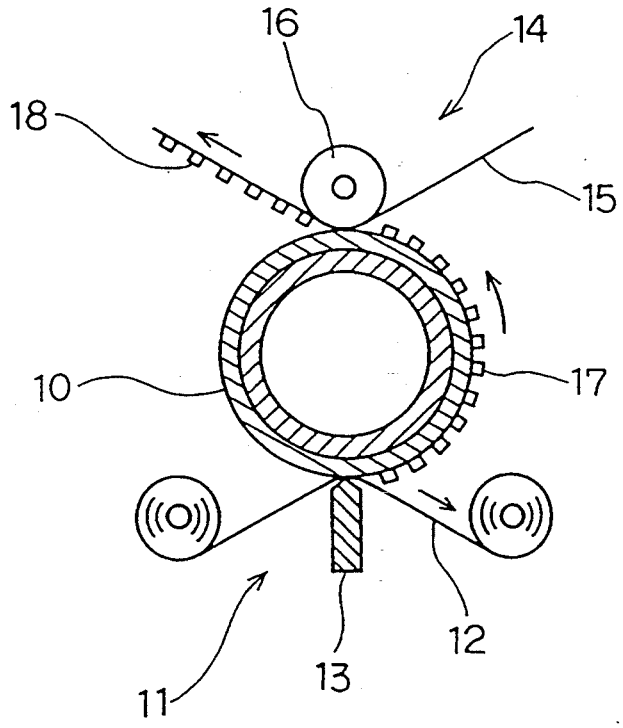
FIG. 1 is an explanatory view showing an example of a printer for use in an indirect transfer method.

With the thermal transfer ink sheet of the above constitution, the transferability of thermal transfer ink onto a transfer drum made of silicone rubber or the like which is being heated as described above and the releasability of the ink on the transfer drum therefrom to a receptor are both satisfactory and, hence a good multi-printing property is achieved. Although the reason for this has not been found yet, it is conceivable that by incorporating the wax compound having a polar group in a thermal transfer ink, the wettability of the ink relative to the releasing surface of the transfer drum is improved with the help of the polar group of the wax, with the result that the transferability and releasability of the ink are adjusted to be well-balanced. In contrast, use of a wax not having a polar group does not ensure good transfer of the ink onto the transfer drum, resulting in an incomplete or collapsed printed image.

The thermal transfer ink layer according to the present invention contains a wax compound having a polar group and a pigment as main ingredients, and optionally contains a heat-meltable resin as required.

Examples of the polar group of the wax compound include —COOH, —OH, $NH_2$, —$NHR^1$, —$NR^2R^3$, —$COOR^4$, —$(CH_2CH_2O)_nH$ where n is an integer of from 1 to 10, —$SO_3H$, —$OCONHR^5$, $R^9$-(-NH-COO—)$_m$ where m is 2 or 3, —$CONH_2$, —$CONHR^6$, —$CONR^7R^8$,

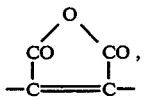

and

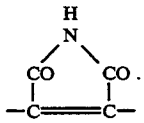

In these groups, $R^1$, $R^2$, $R^3$, $R^4$, $R^5$, $R^6$, $R^7$ and $R^8$ are independently a monovalent organic group, for example an alkyl group (preferably having 1 to 6 carbon atoms), an aralkyl group (preferably having 7 or 8 carbon atoms), an aryl group (preferably having 6 to 12 carbon atoms) and the like. These groups may be each substituted with a lower alkyl group or the like. $R^9$ is a divalent or trivalent organic group, for example an alkylene group (preferably having 1 to 10 carbon atoms), arylene group (preferably having 6 to 13 carbon atoms) and the like. These groups may be each substituted with a lower alkyl group or the like.

Preferred examples of the wax compound according to the present invention include those each having the aforesaid polar group in a linear or branched aliphatic hydrocarbon (preferably having 30 to 150 carbon atoms, more preferably 30 to 70 carbon atoms).

Although the wax compound needs to have at least one polar group on its carbon chain, the content of the polar group is preferably 2 to 30%, more preferably 3 to 30%, and most preferably 3 to 10% relative to the number of carbon atoms of the carbon chain. The wax compound may have one kind of the polar group, or two or more kinds thereof.

Particularly preferred examples of the wax compound include an oxidized microcrystalline wax and wax compounds each having the polar group of —O-CONHR$^5$ or R$^9$-(NHCOO—)$_m$.

Examples of the aforesaid heat-meltable resin include ethylene resins such as ethylene-vinyl acetate copolymer resin (the content of vinyl acetate: 10 to 40% by weight), ethylene-ethyl acrylate copolymer resin (the content of ethyl acrylate: 10 to 40% by weight) and ethylene-acrylic acid copolymer resin, diene resins such as styrene-butadiene copolymer resin and 1,2-polybutadiene resin, acrylic ester resins such as acrylic ester and methacrylic ester, polyamide resins, polyester resins, polyurethane resins, rosins, hydrogenated rosins, hydrogenated esters, rosin esters, α-pinene resins, terpene resins, cumarone-indene resins, ketone resins, maleic acid resins, and phenol resins. These heat-meltable resins can be used singly or in combination of two or more species thereof.

Examples of the aforesaid pigment include carbon black, Aniline Black, Perylene Black, Naphthol Yellow S, Hansa Yellow 5G, Benzidine Yellow, Quinoline Yellow Lake, Permanent Red F5R, Brilliant Carmine 6B, Pigment Scarlet 3B, Rhodamine Lake B, Victoria Blue Lake, metal-free Phthalocyanine Blue and Phthalocyanine Blue.

The thermal transfer ink layer may be incorporated with a dispersant such as surface active agent so as to improve the dispersing of the pigment.

The following Table 1 shows preferred ranges for the respective contents of the aforesaid ingredients of the thermal transfer ink layer according to the present invention, the ranges ensuring the transferability onto a transfer drum, releasability from the transfer drum onto a receptor, adhesion to the receptor such as paper, and multi-transferability.

TABLE 1

| Ingredient | Content (% by weight)* | |
|---|---|---|
| | Preferred range | More preferred range |
| Wax compound | 20–80 | 40–70 |
| Resin | 0–20 | 5–20 |
| Pigment | 15–50 | 25–40 |
| Dispersant | 0–5 | — |

(Note)
*The contents are based on the total amount of solid components in the ink layer.

If the content of the wax compound is less than the above-noted range, the transferability onto the transfer drum becomes poor, while if it exceeds the range, the multi-transferability becomes insufficient with the transfer drum subjected to significant contamination (which is caused by friction of the ink sheet against the transfer drum).

The resin is preferably mixed with other ingredients so as to improve the clearness of printed images. Desired impovement in clearness cannot be expected with the resin content less than 5% by weight. In contrast the resin content in excess of the above-noted range results in poor transferability onto the transfer drum.

A content of the pigment in excess of the above-noted range results poor transferability onto the transfer drum, while on the other hand if it is less than the range, the density of a printed image decreases undesirably.

To ensure good clearness of printed images and prevent the transfer drum from staining, the melt viscosity of the thermal transfer ink layer is preferably within the range of 1 to 5,000 poises, more preferably 100 to 1,000 poises (melt viscosity is a value at a temperature higher by 30° C. than the melting point or softening point of ink and measured with a rheometer manufactured by Rheology Co., Ltd., hereinafter the same). The melt viscosity below the aforesaid range is likely to produce collapsed printed images and contamination, while on the other hand if it is greater than that range, the releasability to the receptor becomes poor. Although the melting point or softening point of the ink layer is not particularly limited as long (as it is not less than the temperature of the transfer drum heated, it is preferably set within the range of 1° to 30° C. above that temperature.

The thermal transfer ink layer can be formed by dispersing or dissolving each of the aforesaid ingredients in a suitable organic solvent to prepare a coating liquid and applying the coating liquid on a foundation with use of an appropriate applying means such as roll coater, gravure coater, reverse coater or bar coater, followed by drying.

The amount of ink layer to be applied is suitably from about 5 to about 20 g/m$^2$ in terms of solid content thereof.

As the foundation used in the present invention there can be employed polyester films and polyamide films as well as various plastic films usually used as a foundation film for ink sheets of this type. When such plastic films are .employed, it is desirable to prevent the foundation from sticking to the thermal head by providing a conventionally known stick-preventing layer on the back side (the side in slide contact with the thermal head) of the foundation. The stick-preventing layer is composed of one or more of various lubricative heat-resistant resins including silicone resin, fluorine-containing resin, nitrocellulose resin, resins modified with the foregoing resins, and mixtures of the foregoing heat-resistant resins with a lubricant. The foundation and/or the stick-preventing layer may contain an antistatic agent or the like. In addition the foundation may also be a thin sheet of paper having a high density such as condenser paper. The thickness of the foundation is preferably about 1 to about 9 μm, particularly about 2 to about 4.5 μm for assuring good heat conduction.

In multi-printing according to the indirect thermal transfer method with use of the thermal transfer ink sheet of the present invention, clear printed images can be obtained using the same part of the ink sheet regardless of the kind of the receptor. As the receptor there can be used various materials including various types of paper, plastic films, various kinds of cloth and the like.

Whilst the foregoing description is mainly directed to the case where the thermal transfer ink sheet according to the present invention is applied to the indirect thermal transfer method, it is needless to say that the thermal transfer ink sheet according to the present invention can also be applied to the direct thermal transfer method.

BEST MODE FOR CARRYING OUT THE INVENTION

Next, the present invention will be described by way of Examples and Comparative Examples.

Example 1

A thermal transfer ink layer was formed by applying a coating liquid of the following formula onto a 4.5 μm-thick polyester film formed on its reverse side with a 0.1 μm-thick stick-preventing layer composed of a silicone-modified urethane resin, followed by drying. The resulting thermal transfer ink layer had a coating amount of 8 g/m$^2$ after drying, a softening point of 90° C. and a melt viscosity of 300 poises (at 120° C.).

| Ingredients | Parts by weight |
|---|---|
| Cardis 320 (oxidized microcrystalline wax made by Petrolite Corporation, melting point: 89° C.) | 12.0 |
| Ethylene-vinyl acetate copolymer (vinyl acetate content: 33% by weight, softening point: 120° C.) | 2.0 |
| Printex 25 (carbon black made by DEGUSSA) | 6.0 |
| Solsperse (dispersant made by ICI) | 1.0 |
| Toluene | 40.0 |
| Isopropyl alcohol | 40.0 |

Comparative Example 1

A thermal transfer ink sheet was produced in the same manner as in Example 1 except for using paraffin wax (melting point: 70° C.) instead of Cardis 320. The softening point and melt viscosity of the ink were 70° C. and 900 poises (at 100° C.), respectively.

Comparative Example 2

A thermal transfer ink sheet was produced in the same manner as in Example 1 except for using microcrystalline wax (melting point: 70° C.) instead of Cardis 320. The softening point and melt viscosity of the ink were 70° C. and 800 poises (at 100° C.), respectively.

Example 2

A thermal transfer ink sheet was produced in the same manner as in Example 1 except for using the following ink liquid for coating. The softening point of the ink was 73° C.

| Ingredients | Parts by weight |
|---|---|
| Urethane wax mentioned below (melting point: 71° C.) | 65.0 |
| Ethylene-vinyl acetate copolymer (softening point: 135° C.) | 5.0 |
| Printex 25 (carbon black made by DEGUSSA) | 30.0 |
| Toluene | 714.0 |

The above urethane wax was prepared in the following manner. Polyethylene wax (BARECO 50 Polywax, made by Petrolire Corporation, weight average molecular weight: 500, average number of carbon atoms: 37.0, softening point: 86° C.) in a molten state was subjected to liquid-phase oxidation using air in the presence of a catalyst to give a secondary alcohol mixture (hydroxyl value: 83.0 mg KOH/g, average number of hydroxyl group per molecule: 0.740), which was then allowed to react with tolylenediisocyanate (95% of the equivalents of hydroxyl value of the secondary alcohol) to obtain the urethane wax.

Each of the ink sheets thus obtained was subjected to a printing test with use of the indirect thermal transfer device shown in FIG. 1 and then evaluated for the following items. The transfer drum as used in the test was coated with silicone rubber and heated at 70° C. The receptor as herein used was a plain paper.

(i) Transferability

The transferability of ink onto the transfer drum was rated on the basis of the following criteria:

3 . . . a predetermined amount of ink is transferred onto the transfer drum;

2 . . . an insufficient amount of ink is transferred thereonto;

1 . . . little amount of ink is transferred thereonto.

(ii) Density of printed image

The image printed on the receiving paper was measured for its OD value.

(iii) Clearness of printed image

The clearness of the image printed on the receiving paper was rated by visual observation.

3 . . . clear

2 . . . a little unclear

1 . . . unclear (iv) Contamination

The degree of contamination on the surface of the transfer drum was rated by visual observation, the contamination being due to friction between the transfer drum and the ink sheet.

3 . . . free of contamination

2 . . . a little contamination

1 . . . substantial contamination (v) Untransferred ink

To what extent the image on the transfer drum had been untransferred onto the receiving paper was rated by visual observation.

3 . . . no untransferred ink

2 . . . a little untransferred ink

1 . . . much untransferred ink

The results of the above test are shown in Table 2.

TABLE 2

| | Ex. 1 | Com. Ex. 1 | Com. Ex. 2 | Ex. 2 |
|---|---|---|---|---|
| Transferability | 3 | 1 | 2 | 3 |
| Density of printed image (OD value) | | | | |
| 1st Printing | 1.2 | — | 0.4 | 1.0 |
| 5th Printing | 1.0 | — | 0.6 | 1.2 |
| 7th Printing | 0.4 | — | 0.4 | 0.4 |
| Clearness | 3 | — | 1 | 3 |
| Contamination | 3 | 1 | 1 | 3 |
| Untransferred ink | 3 | — | 2 | 3 |

We claim:

1. A thermal transfer printing method comprising the steps of: heating a multi-usable thermal transfer ink sheet by means of a thermal head to transfer the ink of the ink sheet onto the surface of a transfer drum, said drum heated to a temperature of 60° C. to 80° C. and said surface having a releasing property, transferring the ink image formed on said drum onto a receptor, and repeating the foregoing steps using the same multi-usable thermal transfer ink sheet, wherein the multi-usable thermal transfer ink sheet comprises a foundation and a thermal transfer ink layer disposed on the foundation, said ink layer transferable in portions in terms of the thickness thereof, the thermal transfer ink layer comprising 20 to 80% by weight of a wax compound having a polar group, and 15 to 50% by weight of a pigment, the thermal transfer ink layer having a melt viscosity within the range of 1 to 5,000 poise and a melting/softening point that is not less than the temperature of the heated transfer drum, the wax compound having a polar group being at least one of an oxidized, microcrystalline wax and a wax having an urethane bond obtained by reacting a diisocyanate with a secondary alcohol obtained by oxidation of a polyethylene wax.

2. The thermal transfer printing method of claim 1, wherein said thermal transfer ink layer comprises 40 to 70% by weight of said wax compound having a polar group, 5 to 20% by weight of a heat-meltable resin and 25 to 40% by weight of said pigment.

3. The thermal transfer printing method according to claim 1, wherein the surface of the drum comprises a silicone rubber or a fluorine-containing rubber.

* * * * *